United States Patent [19]

Janos et al.

[11] Patent Number: 4,941,274

[45] Date of Patent: Jul. 17, 1990

[54] CROSS COUNTRY SKIING BOOT

[75] Inventors: František Janoŝ; Josef Ŝtorek, both of Skuteĉ; Ladislav Křepelka, Gottwaldov, all of Czechoslovakia

[73] Assignee: Obuvnicky prumysl SVIT statni podnik, Gottwaldov, Czechoslovakia

[21] Appl. No.: 339,056

[22] Filed: Apr. 14, 1989

[30] Foreign Application Priority Data

Apr. 14, 1988 [CS] Czechoslovakia ..... 2537-88

[51] Int. Cl.[5] ..... A43B 5/04

[52] U.S. Cl. ..... 36/117; 280/615

[58] Field of Search ..... 36/117–121; 280/615

[56] References Cited

U.S. PATENT DOCUMENTS

| | | | |
|---|---|---|---|
| 4,309,834 | 1/1982 | Bente | 36/117 |
| 4,335,531 | 6/1982 | Salomon | 36/117 |
| 4,487,427 | 12/1984 | Salomon | 36/117 X |
| 4,551,931 | 12/1985 | Bente | 36/117 |
| 4,789,178 | 12/1988 | Olivieri | 280/615 |

FOREIGN PATENT DOCUMENTS

| | | | |
|---|---|---|---|
| 169429 | 1/1986 | European Pat. Off. | 36/117 |
| 2803552 | 8/1979 | Fed. Rep. of Germany | 36/117 |
| 3538427 | 5/1986 | Fed. Rep. of Germany | 280/615 |
| 2906484 | 10/1986 | Fed. Rep. of Germany . | |
| 3610094 | 10/1986 | Fed. Rep. of Germany | 36/117 |
| 3723562 | 1/1988 | Fed. Rep. of Germany | 36/117 |

*Primary Examiner*—Paul T. Sewell
*Assistant Examiner*—Andrew D. Meyers
*Attorney, Agent, or Firm*—Ostrolenk, Faber, Gerb & Soffen

[57] ABSTRACT

A skiing boot, particularly for cross country skiing, is constructed of an upper and a sole. A binding mechanism for pivotally binding the skiing boot to a ski is located toward the front, on the bottom of the sole, in the region of the toe. Extending rearwardly from the ski boot binding mechanism to the heel is a longitudinally extending, V-shaped groove which is formed in the bottom of the sole. The V-shaped groove extends at an angle of about 1°–3° relative to the longitudinal axis of the sole and lies on the outer side and intersects the longitudinal axis in the toe region. Preferably, the ski binding mechanism is located about 9 to 13 millimeters from the front edge of the sole.

11 Claims, 1 Drawing Sheet

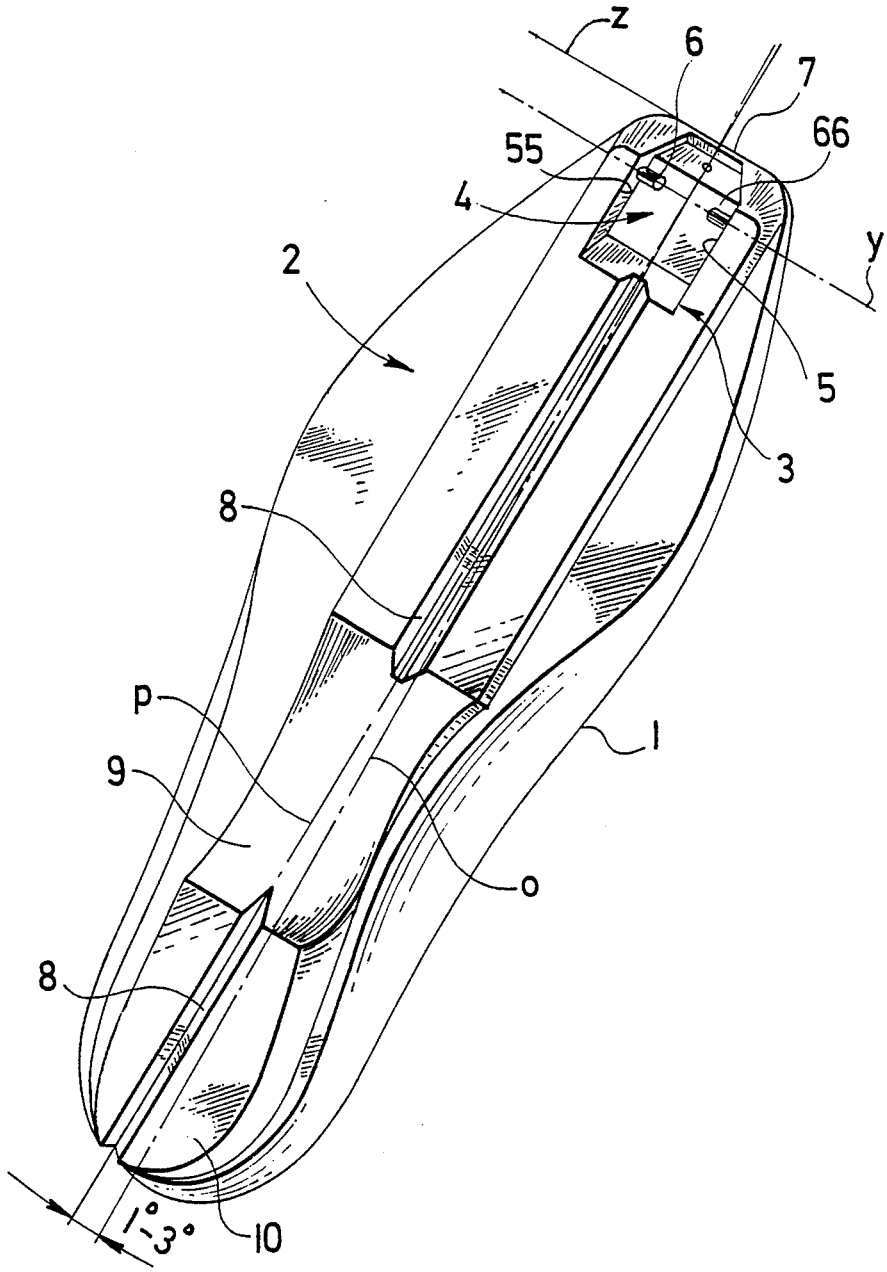
z
6
7
66
55
4
y
2
5
3
8
p
1
9
o
8
1°-3°
10

CROSS COUNTRY SKIING BOOT

BACKGROUND OF THE INVENTION

The present invention relates to a cross country skiing boot and, more particularly, to a skiing boot of the type which is provided on the bottom, in the sole of the boot, with a longitudinally extending V-shaped groove for mating with a complementary shaped upraised structure on a ski.

More specifically, the present invention is related to a cross country skiing boot of the type which is constructed of an upper and a sole, wherein the sole has an upper side facing the upper and a bottom side. On the bottom side of the sole, in the toe region, there is a binding mechanism for fastening the boot to a ski in a pivotable and removable manner which permits the raising of the heel of the skiing boot. This type of binding enables the skier to stand on the toes, ballet style, when and if necessary or desired, e.g. for walking purposes. The aforementioned V-shaped groove extends from the binding mechanism in the toe region rearward, to the heel of the sole.

The popularity of skiing and recent improvements in cross country skiing techniques have engendered a growing demand for improvements in the design and construction of skiing boots. An emphasis of this demand has been on obtaining more reliable control over the ski during all phases of ski maneuvering including running or prolonged sliding while, at the same time, reducing to a minimum the physical effort expended. Thus far this demand has resulted in various improvements in cross country skiing boots including in new elements and modifications in the construction of both the upper and the sole of the boot.

These improvements include the aforementioned binding mechanism for binding the ski boot to the ski which mechanism is located in the toe region and enables the boot to pivot about a transverse axis relative to the ski. In many boots this ski binding structure is constructed as a cutout in the bottom, at the toe region, of the sole and pins in the cutout which pins serve to snag a complementary structure on the ski for holding the ski while permitting the skiing boot to pivot relative thereto.

This binding construction has, however, increased the effort needed for running, especially during long distance skiing when a skier is apt to stand on his/her tiptoes, ballet-style, over prolonged periods.

There was also a problem, with the type of skiing boot described here, which arose from the tendency of the heel portion of the skiing boot to veer to the outside, particularly when a skier was practicing a so-called "skating-off" technique. The aforementioned V-shaped groove has been provided in an effort to solve this problem. In a conventional skiing boot, this V-shaped groove extends longitudinally, either directly along or parallel to the longitudinal axis of the skiing boot. This veering problem has been remedied to a degree by positioning the V-shaped groove to interengage a complementary, longitudinally extending, wedge-shaped structure on the ski. This solution restricts the ability of the rear of the skiing boot to veer out.

Nonetheless, the V-shape of the aforementioned groove and wedge arrangement is such that, inherently, the skiing boot can still slip slightly relative to the ski. The resulting mild veering of the heel of the skiing boot still has an adverse effect on the effort and energy needed to ski over long distances.

SUMMARY OF THE INVENTION

The primary object of the present invention is to provide an improved skiing boot which is free of the aforementioned disadvantages of conventional cross country skiing boots.

The foregoing and other objects of the invention are realized by a skiing boot which is comprised of an upper and a sole, the upper and the sole defining a foot receiving space and the sole having an upper side facing the upper and a bottom side.

In the sole, on the bottom side and at the toe region thereof, there is provided a ski binding mechanism effective for pivotably and removably connecting the sole of the skiing boot to a complementary binding structure located on a ski, the binding structure being such as to enable the skier to pivot his/her foot, i.e. stand on the toes over the ski.

According to a preferred embodiment, the ski binding mechanism is constituted by a pair of pins which are located in a cutout, preferably a cylindrical cutout, in the toe region of the sole. The pins extend toward one another from opposite walls in the cutout and lie on a transverse axis which is preferably located about 9 to 13 millimeters from the front edge of the sole.

According to the salient feature of the present invention, on the bottom of the sole of the skiing boot, there is further provided a straight V-shaped groove which groove extends generally along the longitudinal direction of the sole. More specifically, the groove extends at a small angle of about 1–3 degrees relative to the longitudinal axis of the sole, the center representing the deepest part in the groove lying on the outer side of and intersecting the longitudinal axis at the toe region.

There are three main advantages to the improved skiing boot of the present invention. First, the location of the pivoting axis of the ski binding mechanism about 9 to 13 millimeters behind the front edge of the sole increases comfort by lowering the degree of fatigue of the skier, especially during long distance skiing or racing events.

Second, the location of the binding mechanism as set forth above results in a better fit between the ski and the boot, due, in part, to elimination of longitudinally directed sag.

Third, the offsetting of the V-shaped groove from being coaxial or parallel to the longitudinal axis to a slightly angled orientation produces a virtually perfect guiding of a ski while one practices certain skiing techniques, for example, very sharp "skating-off" maneuvers. This advantage is obtained because the slight lateral displacement of the skiing boot relative to the ski when the boot lies flat against the ski compensates for the pronation effect which is associated with a human foot. The net result of the reorientation of the V-shaped groove is that the skiing boot, the user's foot, and the ski are perfectly aligned during the aforementioned skiing maneuvers. The foregoing represents a very significant advantage, particularly for competitive sport events and during a long distance skiing events.

Other features and advantages of the present invention become apparent from the following description thereof which refers to the accompanying figure.

BRIEF DESCRIPTION OF THE DRAWING

The single figure is a perspective of a skiing boot, viewed from the bottom side thereof.

DETAILED DESCRIPTION

Referring to the drawings, a cross country skiing boot according to the present invention is essentially comprised of an upper 1 and a sole 2. The upper 1 has a substantially conventional construction and performance and is constructed of leather, or of various waterproof materials, or, if needed or desired, of combinations of these materials. Typically, the upper 1 further includes reinforcing elements (not shown) as well as cushioning, all for the purpose of increasing the utility and user's comfort thereof. The upper 1 is fastened to the upper side (not shown) of the sole 2, i.e. oppositely to the viewable, bottom side of the sole 2 which is seen in the Figure. The sole 2 may be constructed from plastic material, for example, from polyamides or from thermoplastic elastomers.

The sole 2 has a toe region 3 where the sole is thickest and in the toe region 3 a centered cavity or cutout 4 which is open and accessible on the bottom side of the sole 2. The cavity 4 extends transversely to a longitudinal axis "O" of the boot and has defined therein a first side wall 5, a second juxtaposed side wall 55 and ski binding means which in the illustrated embodiment is comprised of a pair of pins 6 and 66. The pins 6 and 66 project into the interior of the cavity 4 from the opposed side walls of 5 and 55 and extend along a "Y" axis which is nearly perpendicular to the longitudinal axis "O". The "Y" axis represents therefore the axis about which the cross country skiing boot is pivotable relative to a ski (not shown). Preferably the "Y" axis is located at a distance of about 9 to 13 millimeters behind the front straight edge 7 of the sole 2 which coincides with the straight line Z.

A key feature of the present invention resides the provision of a guiding groove 8 in the bottom of the sole 2, the groove 8 extending generally along the longitudinal direction of the sole 2. This guiding groove 8 is wedge or V-shaped and has a first section which is located nearer the toe region 3 and a second section in line with the first section and located at the heel 10. The aforementioned first and second sections of the groove 8 are separated by the depression 9 in the sole 2 which accommodates the arch of the foot.

The line extending along the center, deepest point, in the V-shaped groove 8 is identified in the Figure by the reference character P. The groove 8 is so situated and oriented that the center of the line P thereof lies on the outside region of the longitudinal axis "O" (to the left of the axis "O" in the Figure) and intersects the longitudinal axis "O" in the toe region 3, at an angle of about 1 to 3°. The transverse axis Y of the pins 6 and 66 is perpendicular to the axial line P of the groove 8.

The cross country skiing boot of the present invention obviously includes all the conventional components of ski boots including boot laces at the upper 1 for tying the boot on the foot of a wearer. Alternatively, instead of boot laces, the upper 1 may comprise a pair of flaps which are fastened to one another by means of a "Velcro" connection. The "Velcro" connection, for example, can consist of a velcro piece on one of the flaps and a receiving loop on the other flap. Or, a single flap may be provided which is capable of being clamped to a receiving buckle or the like on the heel of the boot.

Thus, in accordance with the present invention, the skier's feet position on the skis is such that the heels of the skier are slightly pointed, at an angle of 1–3 degrees, toward one another when the skier stands flat on a pair of standard skis which extend parallel to each other. This practically imperceptible expedient effectively compensates the slight veering which otherwise results from the slippage between the V-shaped surfaces of the groove 8 and the complementary upraised wedge structure (not shown) on the ski, which has produced the undesirable slight outward veering of the heel in the prior art skiing boots. In contrast, the boot of the present invention assures that the foot of the skier extends perfectly coaxially with the ski, even while practicing the various, previously mentioned, skiing techniques.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A ski boot, comprising:

an upper and a sole, the sole having an upper side facing the upper and a bottom side, the sole further having a longitudinal axis associated therewith, a toe region, a heel region, an inside region on one side of the longitudinal axis, and an outside region on the other side of the longitudinal axis;

ski boot binding means for pivotally binding the ski boot to a ski, the ski boot binding means located at the toe region on the sole; and a substantially straight groove having a center extending along the deepest point in the groove, the groove formed in the bottom side of the sole and extending generally in the direction of the longitudinal axis but at a predetermined angle thereto, the center of the groove lying in the outside region of the sole and intersecting t he longitudinal axis at the toe region of the sole, in a manner which is effective to cause the heels of a skier to point toward one another when standing flat on a pair of parallel oriented standard skis.

2. The ski boot of claim 1, wherein the predetermined angle is in the range of 1–8 degrees.

3. The ski boot of claim 2, wherein the groove is V-shaped.

4. The ski boot of claim 3, wherein the ski boot binding means comprises a cutout in the toe region and pin means disposed in the cutout for engaging a complementary binding structure in a ski.

5. The ski boot of claim 4, wherein the pin means comprises first and second pins projecting toward one another from opposite sides in the cutout, the first or second pins lying on a transverse axis which intersects the longitudinal axis.

6. The ski boot of claim 5, wherein the center of the groove intersects the longitudinal axis at the point of intersection of the longitudinal and transverse axes.

7. The ski boot of claim 3, wherein the transverse axis is located about 9–13 millimeters from a front edge of the sole.

8. The ski boot of claim 3, wherein the groove is comprised of first and second sections.

9. The ski boot of claim 3, wherein the upper comprises first and second portions and including fastening means for fastening the first and second portions of the upper to one another.

10. The ski boot of claim 3, wherein the sole is comprised of a synthetic material.

11. The ski boot of claim 10, wherein the synthetic material is a plastic.

* * * * *